US012187476B2

(12) United States Patent
Prakken

(10) Patent No.: US 12,187,476 B2
(45) Date of Patent: Jan. 7, 2025

(54) PACKING MACHINE FOR HORIZONTAL AND VERTICAL PACKING OF ARTICLES INTO A PACKING BOX

(71) Applicant: BluePrint Holding B.V., Woerden (NL)

(72) Inventor: Nicolaas Martin Prakken, Woerden (NL)

(73) Assignee: BluePrint Holding B.V., Woerden (NL)

( * ) Notice: Subject to any disclaimer, the term of this patent is extended or adjusted under 35 U.S.C. 154(b) by 190 days.

(21) Appl. No.: 18/002,282

(22) PCT Filed: Jun. 24, 2021

(86) PCT No.: PCT/EP2021/067431
§ 371 (c)(1),
(2) Date: Dec. 19, 2022

(87) PCT Pub. No.: WO2021/260154
PCT Pub. Date: Dec. 30, 2021

(65) Prior Publication Data

US 2023/0348125 A1 Nov. 2, 2023

(30) Foreign Application Priority Data

Jun. 24, 2020 (NL) ..... 2025906

(51) Int. Cl.
*B65B 35/52* (2006.01)
*B65B 5/06* (2006.01)
(Continued)

(52) U.S. Cl.
CPC ..... *B65B 35/52* (2013.01); *B65B 5/06* (2013.01); *B65B 35/24* (2013.01); *B65B 35/44* (2013.01); *B65B 43/52* (2013.01)

(58) Field of Classification Search
CPC ..... B65B 35/52; B65B 5/06; B65B 35/44
(Continued)

(56) References Cited

U.S. PATENT DOCUMENTS 4,258,527 A * 3/1981 Steinbrecher ..... B65B 5/061 53/448
4,267,918 A * 5/1981 Steinbrecher ..... B65B 43/42 198/465.1

(Continued)

FOREIGN PATENT DOCUMENTS

DE 102015108895 A1 12/2016
EP 1268317 A2 1/2003

(Continued)

OTHER PUBLICATIONS

Delta Robot—article by Wikipedia. Retrieved from URL https://en.wikipedia.org/wiki/Delta_robot on Aug. 21, 2024 (Year: 2024).*

(Continued)

*Primary Examiner* — Valentin Neacsu
(74) *Attorney, Agent, or Firm* — N.V. Nederlandsch Octrooibureau

(57) ABSTRACT

A packing machine for packing articles into a packing box comprises a packing box conveyor for conveying packing boxes with the bottom side supported on the packing box conveyor and an open top side directed upward; and an article conveyor for conveying articles, which is arranged adjacent and alongside the packing box conveyor. A pick-and-place arrangement picks articles from the article conveyor to place the articles in a parallel orientation into a packing box that is conveyed on the packing box conveyor, wherein the parallel orientation is an orientation of an article within the packing box which is parallel to an orientation of an article conveyed on the article conveyor. A transverse packing arrangement of the packing machine comprises a cassette and is configured to present an open side of the cassette sideward for collecting articles from the article conveyor into the cassette in a stacked relationship of the articles in the parallel orientation, and subsequently provides the collected articles in a transverse orientation from the (Continued)

cassette into a packing box, wherein the transverse orientation is an orientation of an article which is transverse to an orientation of an article conveyed on the article conveyor.

20 Claims, 8 Drawing Sheets

(51) Int. Cl.
*B65B 35/24* (2006.01)
*B65B 35/44* (2006.01)
*B65B 43/52* (2006.01)

(58) Field of Classification Search
USPC ..... 53/447
See application file for complete search history.

(56) References Cited

U.S. PATENT DOCUMENTS 5,060,455 A * 10/1991 Schmeisser ..... B65B 21/18 53/448
5,778,640 A * 7/1998 Prakken ..... B65B 5/061 53/538
7,093,408 B2 * 8/2006 Duperray ..... B31B 50/006 53/539
8,997,438 B1 * 4/2015 Fallas ..... B25J 9/0093 901/17
2008/0098695 A1 * 5/2008 Monti ..... B65B 43/46 53/381.1
2009/0013641 A1 * 1/2009 Prakken ..... B65B 35/50 53/284.5
2009/0249750 A1 * 10/2009 Black ..... B65B 5/061 901/14
2017/0203861 A1 * 7/2017 Van Halsema ..... B65B 43/52
2020/0346790 A1 * 11/2020 Prakken ..... B65B 1/24
2023/0348125 A1 * 11/2023 Prakken ..... B65B 35/52

FOREIGN PATENT DOCUMENTS

IT RE20100018 A1 9/2011
WO WO 2017/041007 A1 3/2017
WO WO 2020/013687 A1 1/2020

OTHER PUBLICATIONS

BluePrint Automation (BPA) Case Packers, Published Jul. 25, 2018, Retrieved from URL https://www.youtube.com/watch?v=z9d2N6_tMR4 on Aug. 28, 2024 (Year: 2018).*

* cited by examiner

PACKING MACHINE FOR HORIZONTAL AND VERTICAL PACKING OF ARTICLES INTO A PACKING BOX

FIELD OF THE INVENTION

The invention relates to a packing machine for packing articles into a packing box, the machine comprising a packing box conveyor for conveying packing boxes having a bottom side and an opposing top side, wherein, in operation, the bottom side of the packing boxes is supported on the packing box conveyor and an open top side is directed upward, and an article conveyor for conveying articles, wherein the machine is configured to take articles from the article conveyor and to place said articles into a packing box that is conveyed with the bottom side of the packing box on the packing box conveyor and with the top side of the packing box in an open configuration. In another aspect the invention relates a corresponding packing method.

BACKGROUND OF THE INVENTION

Packing machines and methods for packing articles into a packing box are generally known and widely employed to pack various types of objects or products into the packing boxes, for instance, to ship packed articles from a production or distribution facility to a store. The articles have a length, a width and a thickness, of which the thickness is taken as the smallest dimension of the article. The articles may be packed in a regular fashion into the packing boxes in a horizontal orientation with their length and width dimension along the bottom of the packing box and their thickness transverse to the bottom in the height direction of the packing box. The articles may also be packed in a vertical orientation, in which the thickness of the articles is along the bottom of the packing box and one of the length and width dimensions is transverse to the bottom and along the height direction of the packing box.

The known packing machines are configured for either horizontal packing of articles or for vertical packing of articles into packing boxes. Generally it is required to pack same articles in both horizontal and vertical orientations into packing boxes. This will require two types of machines at the packing facility, one for horizontal packing and one for vertical packing. The ratio of horizontal and vertical packing may depend very much on the batch of products to be packed. It may be that one of the machines is very heavily used at a certain moment, while the other one is not or hardly used. Apart from the capital expenditure that is takes to have two types of machine available, it also requires floor space at the packing facility to have the two types of machines. Additionally, it adds complexity to the process to have to distribute the required capacity for horizontal and vertical packaging over both machines.

SUMMARY OF THE INVENTION

It is an objective of the invention to provide a machine and a method that allow for both horizontal and vertical packing of articles into a packing box.

It is another or alternative objective of the invention to provide a machine and a method that allow for concurrent horizontal and vertical packing at a comparable packing capacity of articles into the packing box.

It is yet another or alternative objective of the invention to provide a machine and a method for horizontal and vertical packing that makes very efficient use of available floor space.

It is yet another or alternative objective of the invention to provide a machine and a method that can be employed in a very flexible manner for horizontal and vertical packing of articles in packing boxes.

At least one of the above objectives is achieved by a packing machine for packing articles into packing boxes having a bottom and an opposing top side, the packing machine comprising

- a packing box conveyor configured for conveying the packing boxes, wherein, in operation, the bottom of the packing boxes is supported on the packing box conveyor and the top side is directed upward;
- an article conveyor configured for conveying articles in an article conveying direction over an article conveying surface, wherein the article conveyor is arranged adjacent and alongside the packing box conveyor, and each article has an associated article plane defined to be parallel to the article conveying surface when said article is on the article conveyor;
- a pick-and-place arrangement configured and arranged, in operation, to pick articles, especially individual articles, from the article conveyor and place said articles directly in a parallel orientation into packing boxes on the bottoms of the respective packing boxes that are conveyed on the packing box conveyor with the top sides of the respective packing boxes in an open configuration, wherein the bottoms of the respective packing boxes provide a supporting surface for the articles placed in the packing boxes, and the parallel orientation of an article is an orientation of said article which has the respective article plane parallel to a respective supporting surface; and
- a transverse packing arrangement comprising a cassette that is movable between a collection position and a transfer position, wherein the transverse packing arrangement is configured, in operation, to present in the collection position an open side of the cassette sideward for collecting articles from the article conveyor into the cassette in a stacked relationship of the collected articles in the parallel orientation on a supporting cassette side as the supporting surface, and to subsequently in the transfer position, in which the cassette is rotated with respect to the collection position, provide the collected articles from the cassette in a transverse orientation into a packing box having the top side in an open configuration directed upward, wherein the bottom of the respective packing box provides a supporting surface for the articles provided in the packing box from the cassette, and the transverse orientation of an article is an orientation of said article which has the respective article plane transverse to a respective supporting surface, wherein the packing box conveyor is arranged, in operation, to convey packing boxes to and from the transverse packing arrangement for packing articles by the transverse packing arrangement in the transverse orientation into packing boxes conveyed on the packing box conveyor.

The arrangement of the article conveyor 'adjacent and alongside' the packing box conveyor is intended to mean that the article conveyor is next to the packing conveyor as seen in top view over at least a section of both the article and packing box conveyors (referred to as pick-and-place section). Such configuration allows picking of articles from the article conveyor and placing the articles into packing boxes on the packing box conveyor.

In another aspect the invention provides a packing method for packing articles into packing boxes having a bottom and an opposing top side, the packing method comprising providing a packing box conveyor configured for conveying the packing boxes, wherein, in operation, the bottom of the packing boxes is supported on the packing box conveyor and the top side is directed upward;

providing an article conveyor configured for conveying articles in an article conveying direction over an article conveying surface, and arrange the article conveyor adjacent and alongside the packing box conveyor, and each article has an associated article plane (AP) defined to be parallel to the article conveying surface when said article is on the article conveyor;

providing a pick-and-place arrangement to pick articles, especially individual articles, from the article conveyor and to place said articles directly in a parallel orientation into packing boxes on the bottoms of the respective packing boxes that are conveyed on the packing box conveyor with the top sides of the respective packing boxes in an open configuration, wherein the bottoms of the respective packing boxes provide a supporting surface for the articles placed in the packing boxes, and the parallel orientation of an article is an orientation of said article which has the respective article plane parallel to a respective supporting surface;

providing a transverse packing arrangement comprising a cassette that is movable between a collection position and a transfer position, wherein the transverse packing arrangement is configured to present in the collection position an open side of the cassette sideward for collecting articles from the article conveyor into the cassette in a stacked relationship of the collected articles in the parallel orientation on a supporting cassette side as the supporting surface, and to subsequently in the transfer position, in which the cassette is rotated with respect to the collection position, provide the collected articles from the cassette in a transverse orientation into a packing box having the top side in an open configuration directed upward, wherein the bottom of the respective packing box provides a supporting surface for the articles provided in the packing box from the cassette, and the transverse orientation of an article is an orientation of said article which has the respective article plane transverse to a respective supporting surface, wherein the packing box conveyor is arranged to convey packing boxes to and from the transverse packing arrangement to allow packing articles by the transverse packing arrangement in the transverse orientation into packing boxes conveyed on the packing box conveyor;

conveying packing boxes on the packing box conveyor, wherein the bottom of the packing boxes is supported on the packing box conveyor and the top side in an open configuration is directed upward;

conveying articles on the article conveyor; and at least one of providing articles in parallel orientation into the packing boxes using the pick-and-place arrangement, and providing articles in transverse orientation into the packing boxes using the transverse packing arrangement.

In an embodiment the pick-and-place arrangement comprises at least one pick-and-place robot, optionally at least one pick-and-place delta robot.

In an embodiment the packing box conveyor is arranged adjacent and alongside the transverse packing arrangement to convey packing boxes to and from the transverse packing arrangement.

In an embodiment the transverse packing arrangement comprises a packing box platform configured to support at least one packing box for receiving articles from the cassette in the transfer position into said at least one packing box supported on the packing box platform, and the packing machine is configured to provide empty packing boxes from the packing box conveyor onto the packing box platform and to discharge packing boxes filled with articles from the cassette onto the packing box conveyor.

In an embodiment the packing box platform provides for a filling location at which a packing box, in operation, is filled with articles by the transverse packing arrangement and for at least one idle location at which a packing box can be positioned while another packing box is positioned in the filling location, and the filling location and the at least one idle location are separated as seen along the packing box conveyor to allow discharging a filled packing box from the filling location and providing an empty packing box to the filling location along different respective paths.

In an embodiment the packing machine is configured, in operation, to provide an empty packing box from the packing box conveyor to one of the at least one idle locations of the packing box platform, and subsequently from said one idle location to the filling location of the packing box platform.

In an embodiment the transverse packing arrangement is provided in line in the article conveying direction with the article conveyor at a discharging end of the article conveyor.

In an embodiment the transverse packing arrangement comprises a transfer conveyor for receiving article from the article conveyor and to transfer articles from a discharging end of the transfer conveyor into the cassette arranged at the discharging end of the transfer conveyor, optionally wherein the transfer conveyor is arranged in line with the article conveyor at a discharging end of the article conveyor.

In an embodiment the transfer conveyor is configured to transfer articles from the transfer conveyor into the cassette by driving the transfer conveyor at a velocity providing sufficient speed to each article discharged from the transfer conveyor to bridge a gap between the transfer conveyor and the cassette.

In an embodiment the pick-and-place arrangement is configured and arranged to allow providing articles from the article conveyor onto the transfer conveyor.

In an embodiment the packing machine is configured to initially pre-group articles into at least one set of pre-grouped articles on the transfer conveyor, and to subsequently transfer the pre-grouped articles from the transfer conveyor into the cassette.

In an embodiment the packing machine is configured to pre-group articles in the set of pre-grouped articles having each subsequent article in the set partly overlapping a preceding article in the set, and a preceding article in the set is associated with the discharging end of the transfer conveyor.

In an embodiment the transfer conveyor is arranged in line with the article conveyor at a discharging end of the article conveyor to receive articles directly from the article conveyor on the transfer conveyor at a level lower than a level at which articles are conveyed on the article conveyor.

In an embodiment the pick-and-place arrangement is configured to reposition articles on the article conveyor to allow providing the set of pre-grouped articles on the transfer conveyor.

In an embodiment the pick-and-place arrangement is configured to reposition articles on the article conveyor to provide the set of pre-grouped articles on the transfer conveyor while receiving articles from the article conveyor onto the transfer conveyor.

In an embodiment the transfer conveyor comprises a pre-grouping section for receiving articles from the article conveyor and pre-grouping said articles into a set of pre-grouped articles, and a transfer section in between the pre-grouping section and the cassette for receiving pre-grouped articles from the pre-grouping section and subsequently transferring said pre-grouped articles into the cassette.

In an embodiment the pre-grouping section comprises an endless conveyor belt, and the transfer section comprises an endless conveyor belt.

In an embodiment the transfer conveyor comprises at least two stretches of conveyor belt for driving along a common endless track, each stretch of conveyor belt is driven by a separate drive to allow driving the stretches of conveyer belt independent from one another, articles are initially pre-grouped on a stretch of conveyor belt in the pre-grouping section, and said stretch of conveyor belt is subsequently moved to the transfer section for subsequent transfer of articles into the cassette.

In an embodiment the transverse packing arrangement is configured to move the cassette downward while collecting articles into the cassette, especially to move the cassette downward in a continuous non-stepped fashion while collecting articles into the cassette.

BRIEF DESCRIPTION OF THE DRAWINGS

Further features and advantages of the invention will become apparent from the description of the invention by way of non-limiting and non-exclusive embodiments. These embodiments are not to be construed as limiting the scope of protection. The person skilled in the art will realize that other alternatives and equivalent embodiments of the invention can be conceived and reduced to practice without departing from the scope of the present invention. Embodiments of the invention will be described with reference to the accompanying drawings, in which like or same reference symbols denote like, same or corresponding parts, and in which.

DETAILED DESCRIPTION OF EMBODIMENTS

Figure 1:
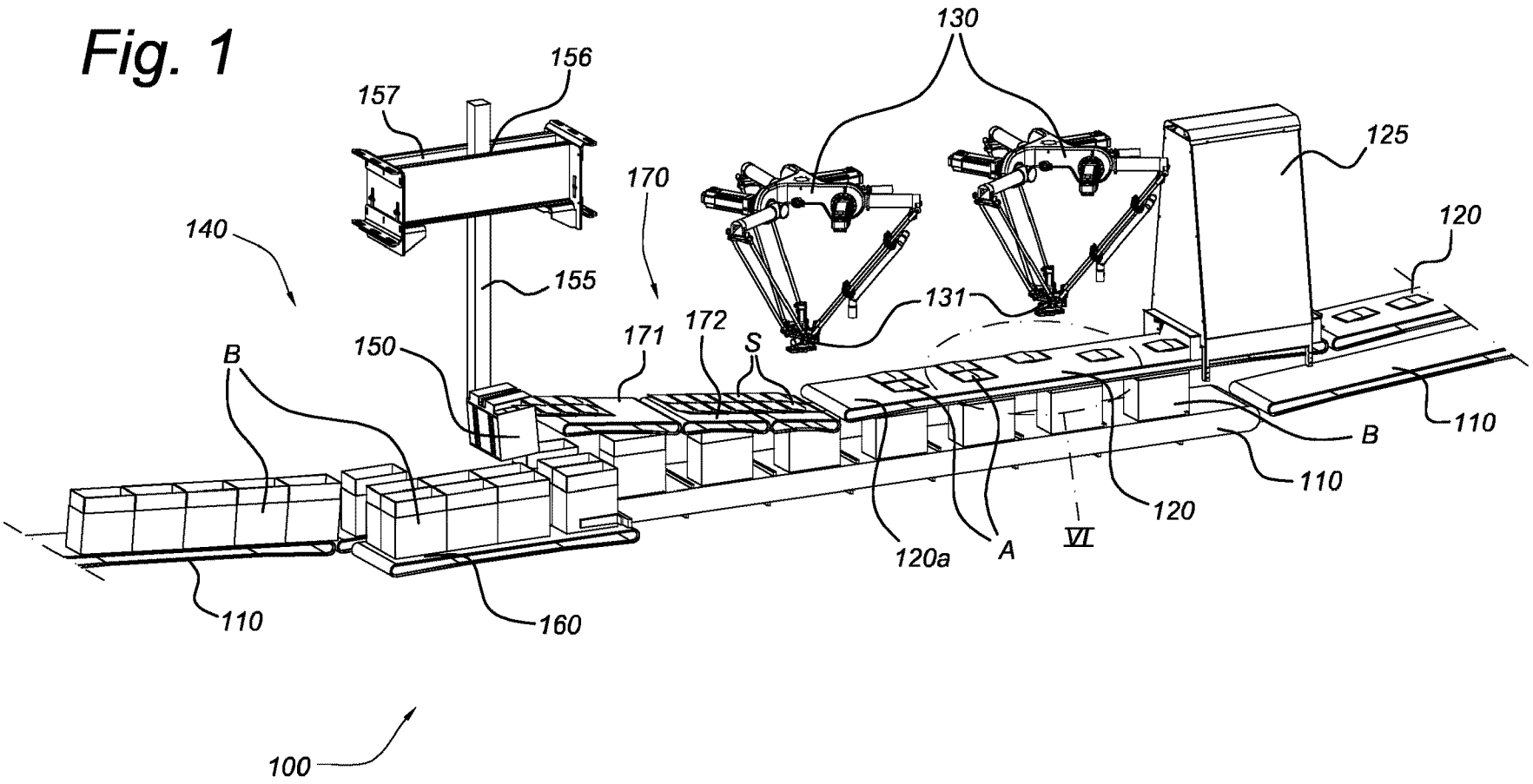
FIG. 1 shows a perspective side view on a packing machine according to the invention.
Figure 2:
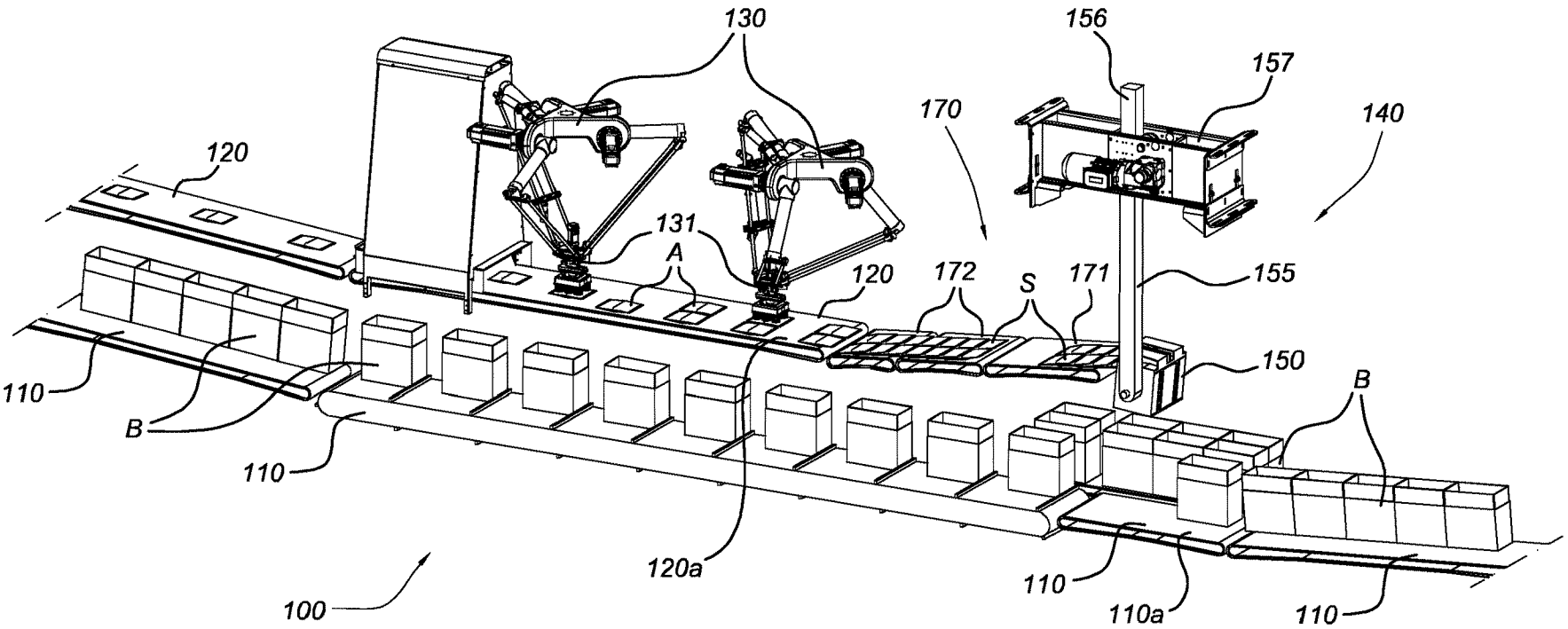
FIG. 2 shows a perspective side on the packing machine of FIG. 1 from the opposing side.
Figure 3:
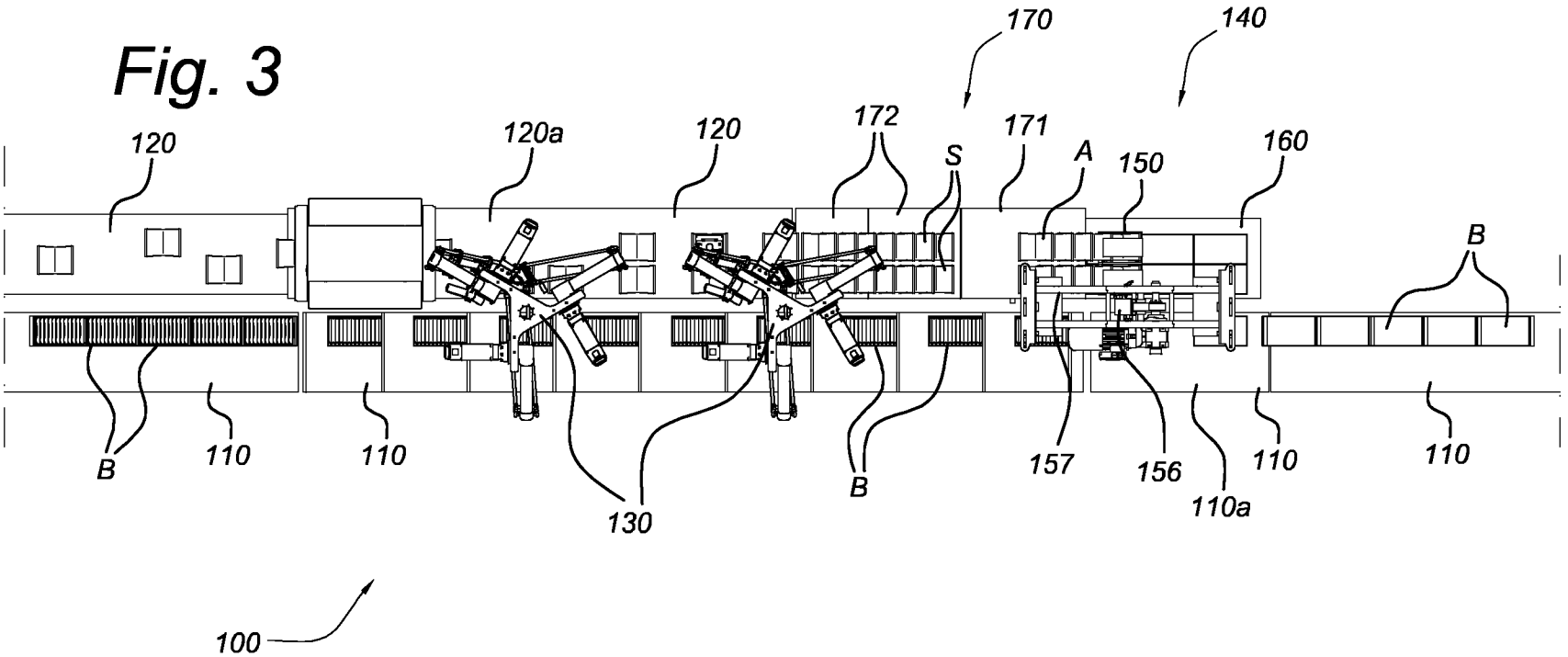
FIG. 3 shows a top view of the packing machine of FIG. 1.
Figure 4:
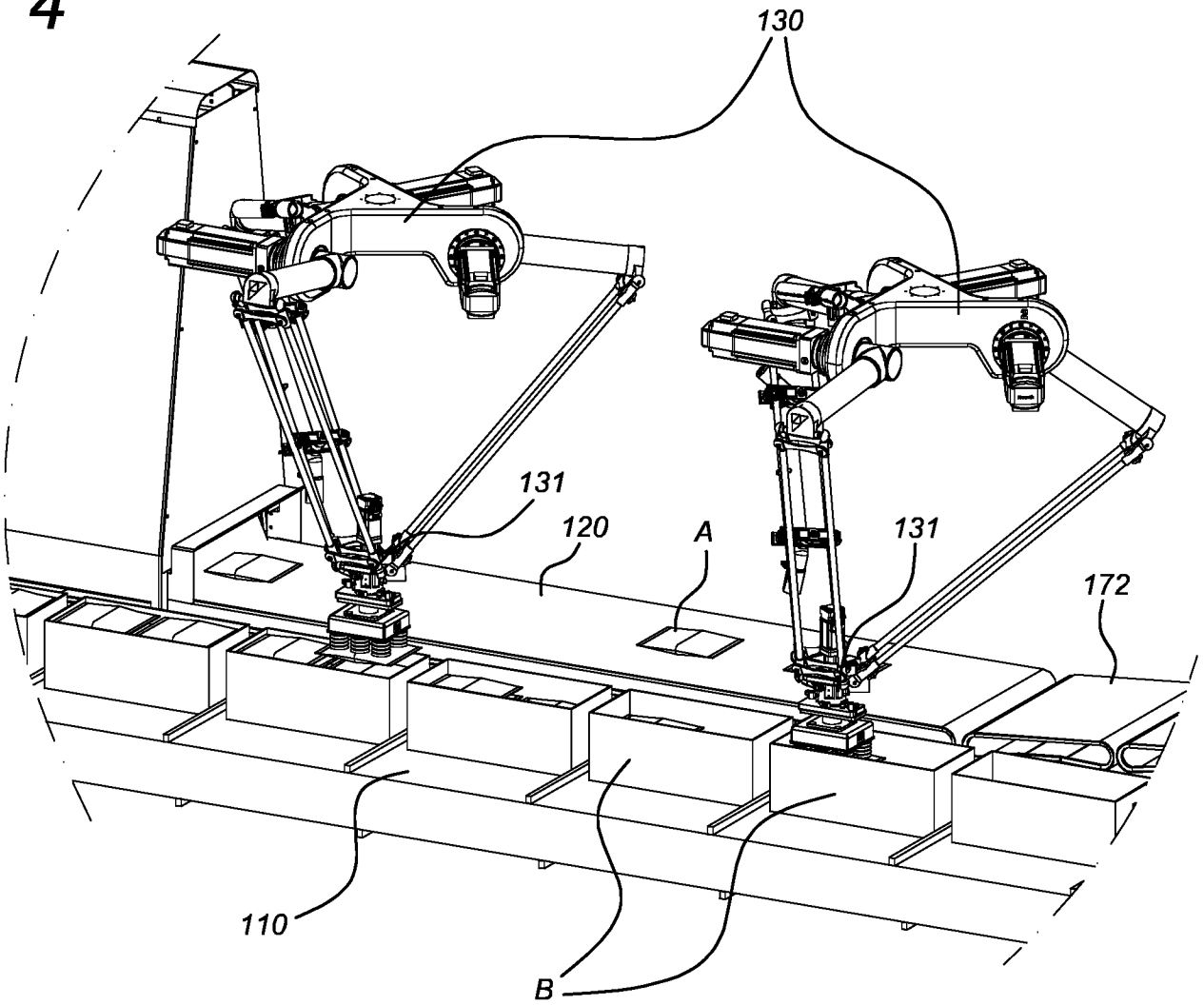
FIG. 4 shows a part of the view of the packing machine of FIG. 2 while packing articles in packing boxes in a parallel horizontal orientation.
Figure 6:
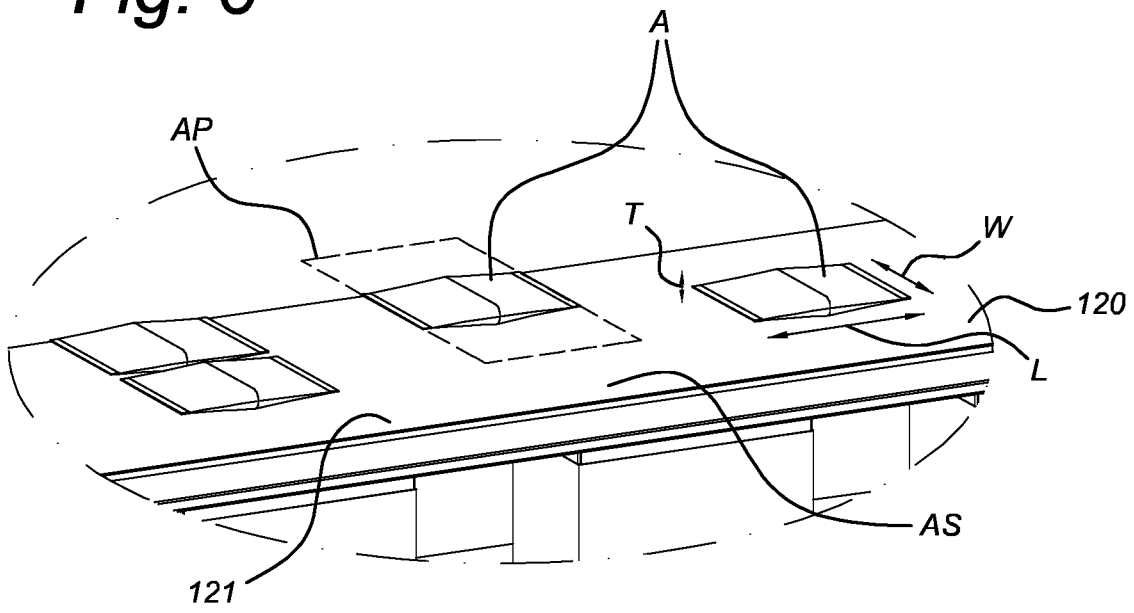
FIG. 6 shows a detail of articles on the article conveyor of the packing machine of FIG. 1.

FIGS. 1, 2 and 3 show a packing machine 100 for packing articles A supplied on an article conveyor 120 into packing boxes B. The articles A can be any type of objects or products that can be packed into packing boxes B. The articles have a length L, a width W and a thickness T, as is shown in FIG. 6. The thickness T is defined as the smallest one of the length, width and thickness dimensions. Usually, in operation, the products are conveyed in a horizontal orientation in an article conveying direction on the article conveyor. The article conveying direction is right to left in FIG. 1. The horizontal orientation means that the thickness direction of the articles is transverse to a conveyor supporting surface 121 of the article conveyor 120 on which the articles A are supported and conveyed. The conveyor supporting surface 121 defines an article conveying surface AS over which the articles are conveyed by the article conveyor 120. Each article A has an associated article plane AP defined to be parallel to the article conveying surface AS when the article is on the article conveyor 120. The article plane AP, which is an imaginary plane, is tied to its associated article and defined to be parallel to the article conveying surface AS when the article is on the article conveyor, while the article plane remains in that manner tied to the article, not to the article conveying surface AS, when handled further in the machine. When the article A is handled further in the machine, for instance, to become rotated into an orientation transverse to an orientation as conveyed on the article conveyor 120, the associated article plane AP will rotate accordingly and also become oriented transverse to the article conveying surface AS. In a horizontal orientation of the articles A conveyed on the article conveyor, the length L and width W dimensions of each article A are parallel to the associated article plane AP and the thickness T dimension is perpendicular to the associated article plane AP. The article conveyor 120 shown in the embodiment of FIGS. 1, 2 and 3 is of the endless belt type, but any other suitable article conveyor can be employed as well.

Figure 10A:
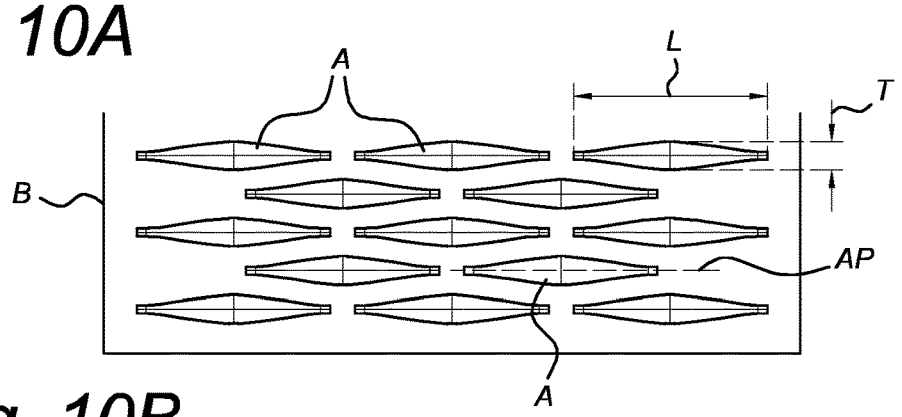
FIGS. 10A and 10B shows articles in parallel horizontal orientation packed in a packing box in cross-sectional and top view, respectively.
Figure 11A:
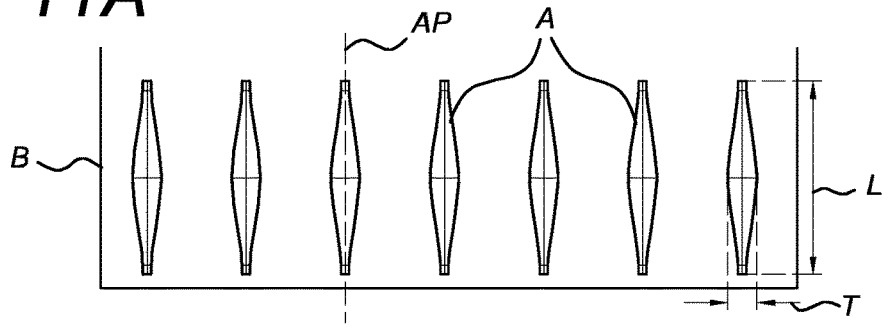
FIGS. 11A and 11B show articles in transverse vertical orientation packed in a packing box in cross-section and top view, respectively.

A parallel orientation of an article is defined as an orientation of the article in which the associated article plane AP is parallel to the supporting surface of the article. A transverse orientation of an article is defined as an orientation of the article in which the associated article plane AP is transverse to the supporting surface of the article. The articles A may be packed in a parallel orientation in the packing boxes B, in which the article plane AP is parallel to the bottom of the packing box on which the articles are supported, as shown in FIG. 10A. This corresponds to a horizontal orientation of the articles in the embodiment shown, in which the length L and width W dimensions are directed parallel to the bottom of the packing boxes and the thickness T dimension transverse to the bottom. Articles may also be packed in a transverse orientation in the packing boxes, in which the article plane AP is transverse to the bottom of the packing boxes on which the articles are supported, as shown in FIG. 11A. In the embodiment shown, this corresponds to a vertical orientation of the articles in the packing boxes, in which the thickness T dimension of the article is directed along the bottom of the packing box and one of the length L and width W dimension of the article is directed transverse to the bottom of the packing box. The packing machine 100 of FIGS. 1, 2 and 3 allows for packing articles in both the parallel and transverse orientations, and thus in both the horizontal and vertical orientations for the embodiment shown, into the packing boxes B.

The packing boxes B are supplied on a packing box conveyor 110. The packing box conveyor 110 and the article conveyor 120 are provided next to one another so that they are arranged adjacent and alongside one another as the figures show. In operation, the packing boxes are conveyed on the packing box conveyor 110 with their bottoms supported on the packing box conveyor and with their top sides in an open configuration and directed upward. The packing box conveyor 110 in the embodiment shown conveys the packing boxes B in counter-flow, from left to right in FIG. 1, to the conveying direction of the articles A on the article conveyor 120, but a conveying direction of the packing boxes in co-flow with the conveying direction of the articles is possible as well.

The embodiment of the packing machine shown in FIGS. 1, 2 and 3 has a pick-and-place arrangement of two pick-and-place delta robots 130 that each have an end-effector 131 for picking up articles A from the article conveyor 120 and for providing the articles into the packing boxes B. Other embodiments may have one pick-and-place robot or more than two robots 130, which will be dependent on a number of factors such as the capacity of the individual robots, the number of products that a packing box can take, and the required packing capacity of the packing machine. The article conveyor is arranged adjacent and alongside the packing box conveyor in at least a pick-and-place section of the packing apparatus 100 where the pick-and-place arrangement is provided. The delta robots 130 pick up the articles A, especially individual articles, from the article conveyor 120 such that the article planes AP remain parallel to the article conveying surface AS, and place the articles into the packing box in the parallel orientation on the bottom of the packing box. While handled by the delta robot, the article remains in an orientation having its associated article plane AP parallel to the article conveying surface AS of the article conveyor, while the article can be rotated by the end-effector of the delta robot around an axis perpendicular to the article plane for a preferred positioning into the packing box. Since the articles will generally be conveyed in a horizontal orientation on the article conveyor 120, the articles will then be placed in horizontal orientation into the packing box as well. The robot may rotate individual articles around a vertical axis for optimal placing in the packing box, but this will maintain a parallel orientation and not change the orientation of the article from a horizontal to a vertical orientation. The pack-and-place arrangement and its robots 130 are in the pick-and-place section arranged along the article conveyor 120 and the packing box conveyor to allow picking articles from the article conveyor and place those articles into packing boxes on the packing box conveyor.

A transverse packing arrangement 140 is provided at the discharging end of the article conveyor 120, in line with the article conveying direction. The transverse packing arrangement allows for packing articles A into the packing boxes B in the transverse orientation. Articles supplied in horizontal orientation on the article conveyor are provided in vertical orientation into the packing boxes by the transverse packing arrangement. The transverse packing arrangement 140 is provided in line with the article conveyor 120, which means that articles A are handled by the transverse packing arrangement in a same flow direction as articles are being conveyed on the article conveyor and that the transverse packing arrangement is provided aligned with the article conveyor and the article conveying direction.

Figure 5A:
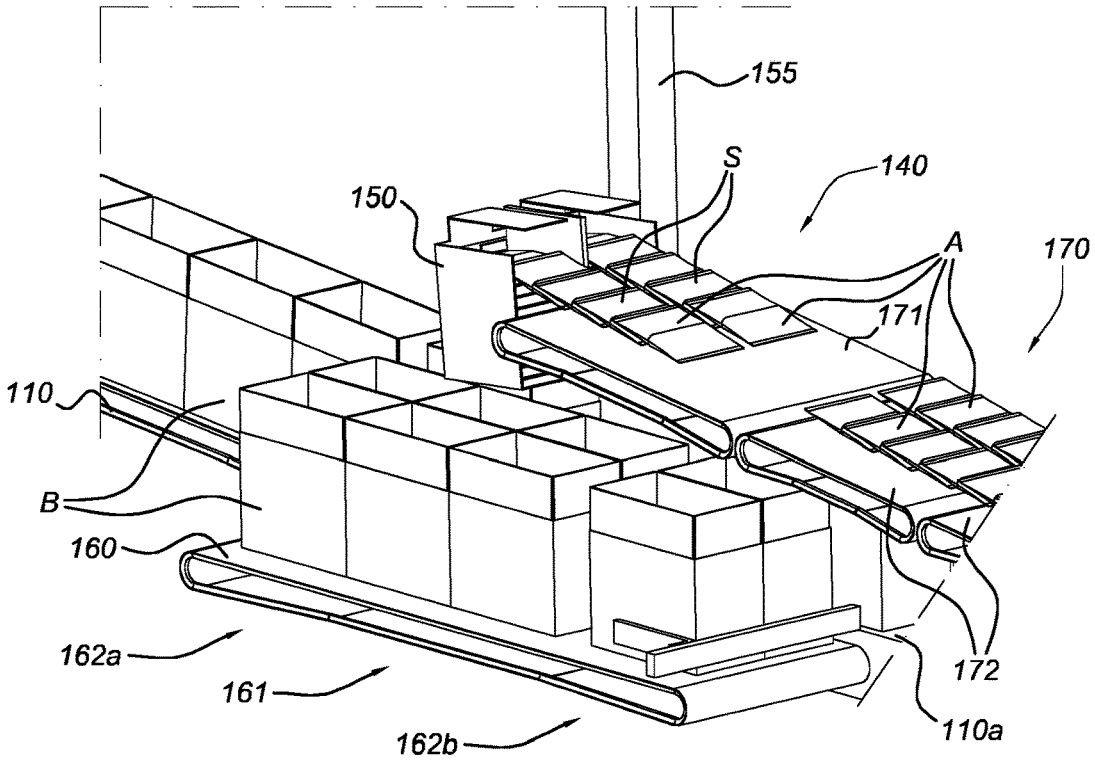
FIG. 5A shows part of the transverse packing arrangement of the packing machine of FIG. 1 while collecting articles in the cassette.

In the embodiment shown, the articles are first provided from the article conveyor 120 onto a transfer conveyor 170 of the transverse packing arrangement 140. The transfer conveyor 170 is arranged at a discharging end of the article conveyor and receives articles from the article conveyor 120, and subsequently transfers the articles from the transfer conveyor into a cassette 150. The transfer conveyor is arranged in line with the article conveyor so that a conveying direction of articles on the transfer conveyor is the same as a conveying direction of articles on the article conveyor. In a collection position of the cassette, as is shown in FIGS. 1, 2 and 5A, the cassette 150 presents an open side thereof sideward in the direction of the article conveyor 120 and the transfer conveyor 170 for collecting articles in the cassette. The cassette is mounted on a beam 155 that can be moved in the vertical direction by a linear drive 156. The linear drive 156 is mounted on another linear drive 157 for moving the beam 155 in a horizontal direction along the article conveying direction of articles on the article conveyor 120. Therefore, the cassette 150 can be translated in a vertical direction and in a horizontal direction along the conveying direction of articles A on the article conveyor. Additionally, the cassette can be rotated by a rotation drive (not shown) mounted on the beam around an axis that is perpendicular to both translation directions. This allows to position the cassette 150 in the collection position with its open side at the discharge end of the transfer conveyer 170 and with the open end toward the transfer conveyor to collect articles discharged from the transfer conveyor, which is achieved by driving the transfer conveyor to forward the articles towards the cassette 150, as is depicted in FIG. 5A.

Articles A are collected in a stacked relationship of the articles in the parallel orientation in the cassette 150 onto a supporting cassette side as a support surface for the articles. The supporting cassette side is the lower horizontal side of the cassette as shown in FIGS. 1, 2 and 5A. The articles maintain their parallel orientation when provided from the article conveyor 120 via the transfer conveyor 170 into the cassette. When the articles are conveyed in horizontal orientation on the transfer conveyor, the articles will be provided in horizontal orientation in the cassette on the supporting cassette side. The transverse packing arrangement 140 moves the cassette downward while articles A are collected into the cassette to provide the articles stacked onto one another in the cassette on the supporting cassette side. The embodiment in FIGS. 1, 2, 3, 5A and 5B actually shows a double cassette 150 having two compartments which allows collecting articles to be provided subsequently in two packing boxes. Alternatively, the double cassette could have been embodied as two fully separate cassettes, or as a single one-compartment cassette providing articles subsequently into two packing boxes at the same time.

In the embodiment shown, the transfer conveyor comprises a pre-grouping section 172 adjacent, at a discharging end of the article conveyor, and in line with the article conveyor 120, and a transfer section 171 adjacent, at a discharging end, and in line with the pre-grouping section 172. The pre-grouping section comprises an endless conveyor belt having a conveying surface that is at a lower level than the conveying surface AS of the article conveyor 120.

Figure 7:
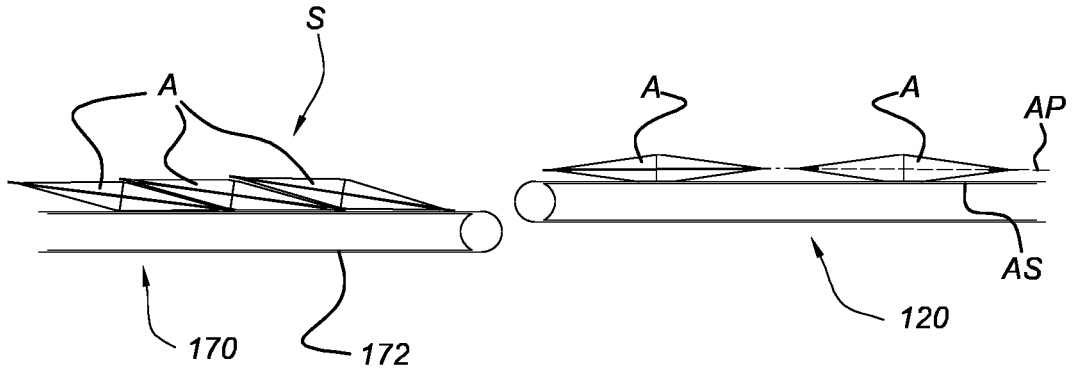
FIG. 7 shows the discharging end of the article conveyor and the receiving end of the transfer conveyor of FIG. 1.

This allows to provide articles in an overlapping relationship, as is shown in more detail in FIG. 7, by appropriately driving the conveyor belt of the pre-grouping section 172 when an article is provided from the discharging end of the article conveyor 120 to the pre-grouping section 172. One or more of the robots 130 are used to reposition articles A, that are to be processed by the transverse packing arrangement for transverse packing, on the article conveyor 120. The one or more robots reposition, which includes reorienting, the articles on the article conveyor to be appropriately positioned on the article conveyor and with respect to one another, and in a desired length wise or width wise orientation. The robots may, for instance position the articles in lines along the conveying direction. As a result, sets S of pre-grouped articles are formed on the conveyor belt of the pre-grouping section when articles are provided from the article conveyor to the pre-grouping section. It is shown in the figures that two sets S of pre-grouped articles are formed in the pre-grouping section 172. Alternatively or additionally, a robot 130 may directly position articles A from the article conveyor 120 onto the conveyor belt of the pre-grouping section to form one or more sets S of pre-grouped articles A. Each set S is shown to consist of a row of overlapping articles A. Each subsequent article in a row partly overlaps a preceding article in the row, and the first article in each row is at an end of the row associated with the discharging end of the transfer conveyor 170 where the articles are provided into the cassette.

An article conveyor segment 120*a* of the article conveyor 120 is arranged in the pick-and-place section having the robots 130 of the pick-and-place arrangement. An optical detection station 125 for detecting position and orientation of each article A on the article conveyor is positioned at the charging end of the segment 120*a*. Each robot 130 of the pick-and-place arrangement picks an article A from the article conveyor segment 120*a* of the article conveyor 120 and places the picked article in parallel orientation into a packing box B on the packing box conveyor 110 or repositions the article on the article conveyor. Regularly, the repositioning is done to provide each repositioned article on a desired position and in a desired orientation on the article conveyor to allow making sets of pregrouped articles on the transfer conveyor 170. This may involve making one or multiple rows of repositioned articles on the article conveyor. At this moment the articles will have random gaps in between the articles in the row on the article conveyor. The articles mainly should be repositioned to be at a desired position as seen in a width direction of the article conveyor and to have a desired orientation. Additionally, an extra row of articles on the article conveyor may be formed of rejected articles, which rejected articles are allowed to drop into a rejection bin from the discharging end of the article conveyor. Making all these rows may require an article conveyor segment 120*a* that has a larger width than the width of segments of the article conveyor upstream of the segment 120*a*.

Figure 9A:
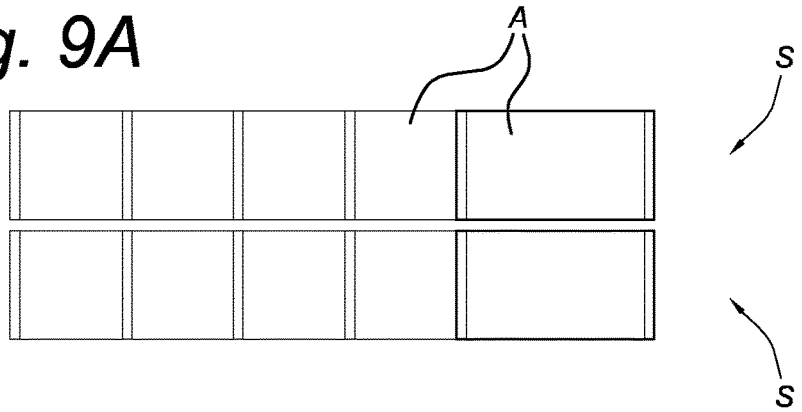
FIGS. 9A and 9B show sets of articles.
Figure 9B:
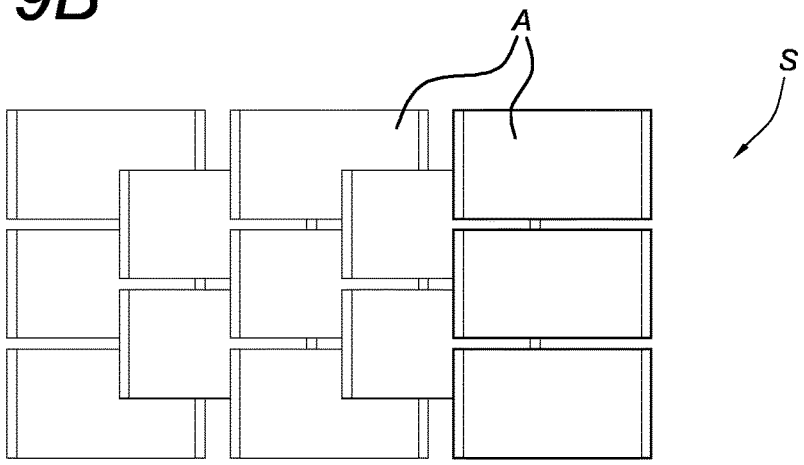
Figure 11B:
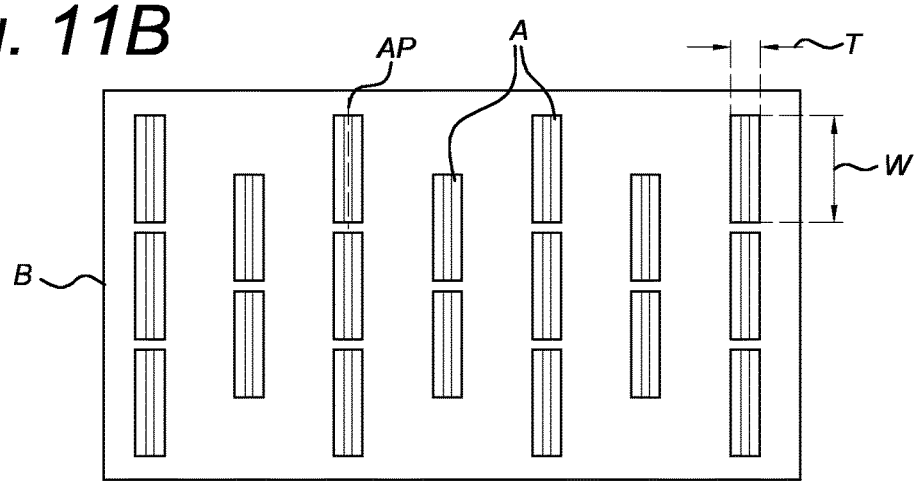

FIG. 9A shows a top view of the two sets S of articles, of which each set consists of one row, for providing into the two cassettes that are arranged next to one another in the double cassette as is shown in FIGS. 1, 2 and 5A. Alternatively, the two rows of articles could be considered as one single set S for providing into a single cassette and subsequently in a single packing box. The robots 130 reposition a duo of two articles next to one another on the article conveyor 120 at appropriate positions in a width direction of the article conveyor from, for instance, initially randomly positioned articles and or articles only provided in a single line in the stream of articles. Subsequently, the duo of articles is provided in an overlapping relationship onto a previous duo of articles of the sets which are already present on the pre-grouping conveyor 172 when the duo of articles is provided from the article conveyor onto the pre-grouping conveyor. FIG. 9B shows a 3-2-3-2-3 arrangement of articles in a set S for an alternative embodiment to obtain a transverse vertical filling of a packing box as shown in FIGS. 11A and 11B. The robots 130 reposition articles on the article conveyor 120 to alternatingly provide duos and triples of articles behind one another on the article conveyor, which are subsequently provided onto the pre-grouping conveyor in an overlapping relationship with a previous triple or duo, respectively, to provide the configuration as shown in FIG. 9B. The packing machine allows to provide articles in various arrangements in packing boxes.

After one or more sets S of pre-grouped articles have been formed in the pre-grouping section 172, the sets S are provided to the transfer section 171. FIGS. 1, 2, 5A and 5B show that the transfer section 171 comprises an endless conveyor belt as well. When having provided the one or more sets S to the transfer section, the conveyor belt of the transfer section is accelerated to be driven at a velocity providing sufficient speed to each article A discharged from the conveyor belt of the transfer section to be launched for bridging the gap between the transfer conveyor 170 and the cassette 150. FIGS. 1, 2 and 5A show that two compartments of the double cassette 150 are filled with articles at the same time.

Figure 8:
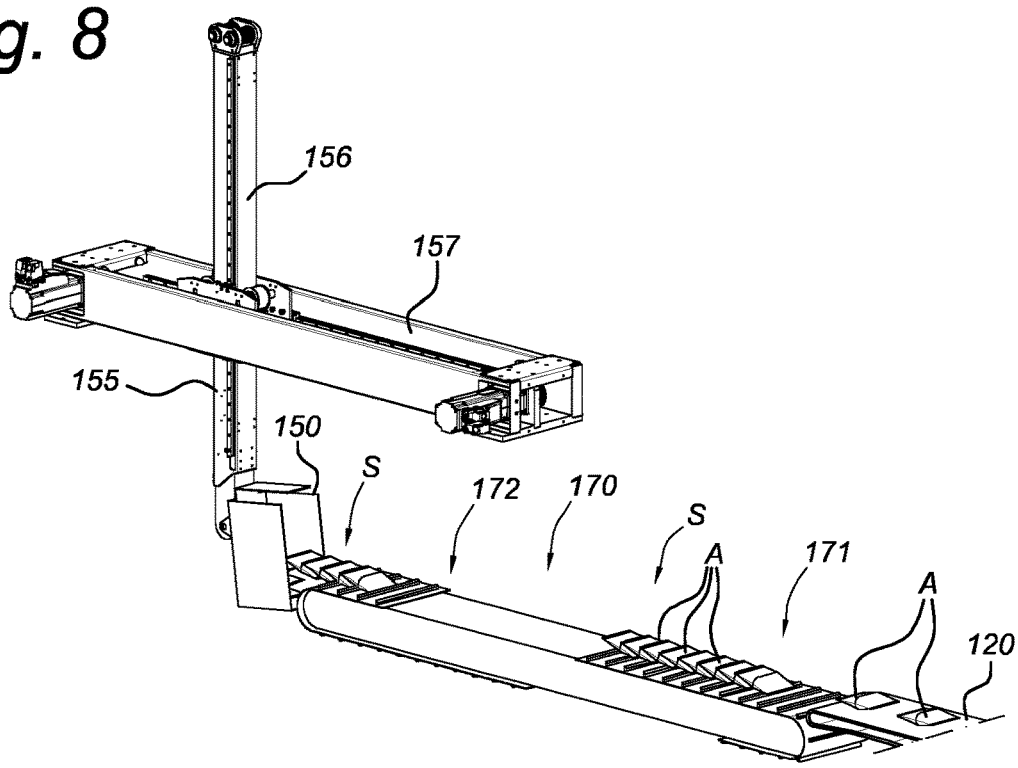
FIG. 8 shows another embodiment of the transfer conveyor.

In an alternative embodiment shown in FIG. 8, the transfer conveyor 171 comprises two or more stretches of conveyor belt that are driven along a common endless track. Each stretch of conveyor belt is driven by a separate drive to allow driving the stretches of conveyer belt independent from one another. Articles A are initially pre-grouped on a stretch of conveyor belt in the pre-grouping section 172 as is described above. Subsequently, said stretch of conveyor belt is moved to the transfer section 171 for subsequent transfer of articles A into the cassette 150 by driving said stretch of conveyor belt in the transfer section at the required velocity as described above. A stretch of conveyor belt can be configured as a continuous stretch of material with, for instance, upright holding strips as shown. Alternatively, a stretch of conveyor belt can be configured by individual lamellae that are coupled to one another or each coupled to their common drive. The skilled person may further envisage equivalent embodiments of a stretch of conveyor belt.

Figure 5B:
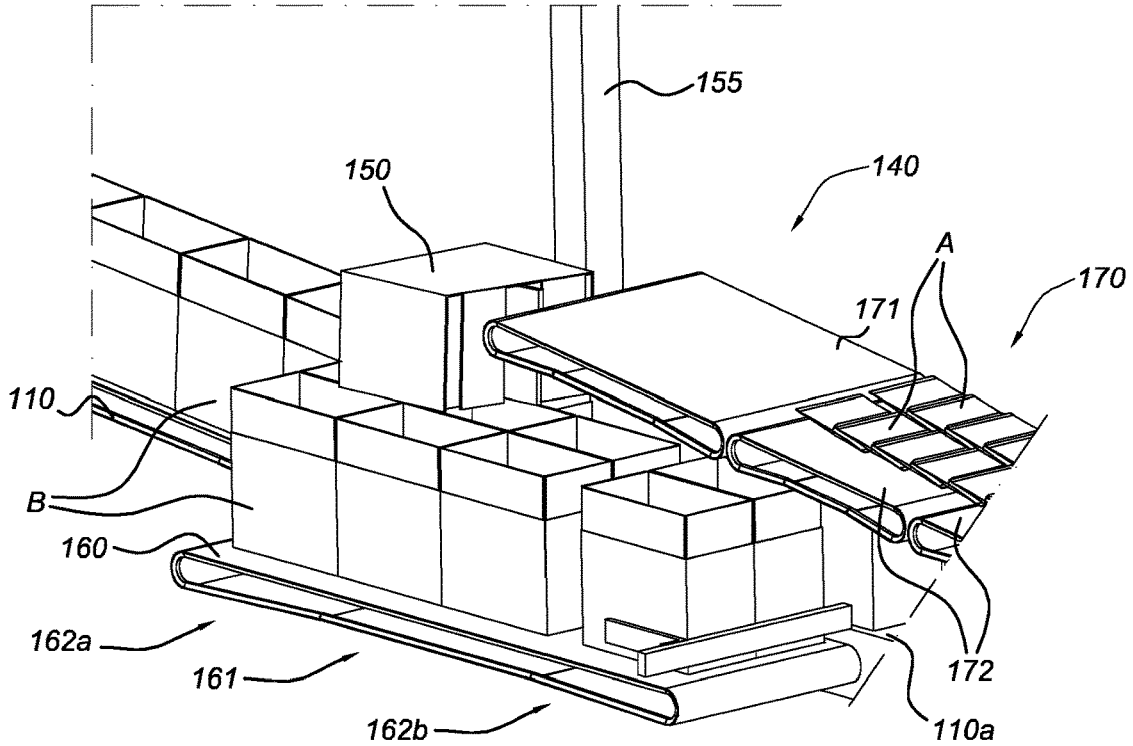
FIG. 5B shows the part of the transverse packing arrangement of FIG. 5A while providing articles from the cassette into a packing box.

After articles A have been provided and collected in the cassette 150 in its collection position, as depicted in FIG. 5A, or in multiple cassettes, a moveable side wall of the cassette is moved inwards to hold the articles in the cassette. The movable side wall is opposite the supporting cassette side of the cassette in the embodiment shown. Other arrangements for holding articles in the cassette can be employed as well. The cassette 150 is moved and rotated to above a packing box B, in its transfer position, with the open side of the cassette facing downward, as is shown in FIG. 5B. The packing box B has its top side open. By releasing the movable side wall of the cassette the articles drop out of the cassette into the packing box in a transverse orientation of the articles in the packing box. When the articles have been conveyed in the horizontal orientation on the article conveyor, the articles will be provided in a vertical orientation in the packing box by the transfer arrangement 140. In an alternative embodiment of the cassette, the cassette has the open side and an openable opposite side. In the transfer position of such alternative embodiment, the open side is rotated upward and the articles are released into a packing box below by opening the openable side, for instance, by employing bomb doors, flaps, retracting plates or any other suitable opening arrangement. The alternative embodiment does not require a holding force to be exerted on the article in the cassette, and allows for providing the articles in an opposite transverse orientation in the packing box. In both embodiments the collected articles are released from the cassette to drop into the packing box.

The packing box conveyor 110 is arranged adjacent and alongside the transverse packing arrangement to provide empty packing boxes to the transverse packing arrangement 140 as well. In the embodiment shown, empty packing boxes with their top sides open are provided from a packing box conveyor segment 110*a* of the packing box conveyor 110 onto a packing box platform 160, especially to an idle location 162*a* of the packing box platform, which can be achieved by pushing the packing boxes from the packing box conveyor onto the packing box platform. The packing box platform comprises a conveyor that subsequently advances empty packing boxes to a filling location 161 of the packing box platform for filling of the packing box with articles by the cassette 150. After filling, filled packing boxes are provided to a second idle location 162*b* and subsequently back again from the second idle location 162*b* to the packing box conveyor segment 110*a* of the packing box conveyor to convey the filled packing boxes from the transverse packing arrangement. Providing empty packing boxes first from the packing box conveyor to the idle location 162*a* on the packing box platform 160, and subsequently from the idle location 162*a* to the filling location 161 allows for a quick positioning of an empty packing box at the filling location and therefor for a fast packing box filling process by the transverse packing arrangement. In an alternative embodiment, filled packing boxes are provided directly from the filling location 161 back to the packing box conveyor. Both embodiments provide discharging a filled packing box from the filling location and providing an empty packing box to the filling location along different respective paths.

The packing box conveyor 110 in the embodiment shown is provided with separate segments that can be operated independently from one another. A segment 110*a* is provided next to the packing box platform 160 and allows providing packing boxes to the packing box platform and to a further segment of the packing box conveyor downstream of segment 110*a*. The further segment of the packing box conveyor 110 is provided next to the transfer conveyor 170 and alongside the article conveyor 120. The embodiment of FIGS. 1 to 3 shows yet further conveyor parts providing packing boxes to the segment next to the packing box platform, and receiving packing boxes from the segment alongside the article conveyor.

In yet another alternative embodiment, which is not shown in the drawings, the packing box conveyor segment 110*a* and the packing box platform 160 are configured to have a series of joint rollers that support the packing boxes, and are so embodied as a joint unit. Each roller extends in a direction transverse to the conveying direction of the packing boxes on the packing box conveyor and spans the widths of both the packing box conveyor segment 110*a* and the packing box platform 160. Some or all of the rollers are driven for advancing the packing boxes in the packing box conveying direction. A set of fingers can be pushed upward between the rollers and moved along the rollers to push a packing box over the rollers from the packing box conveyor segment part of the rollers to the packing box platform part of the rollers, or vice versa. Stops can be pushed upward between rollers to halt advancing a packing box in its conveying direction while rollers are being driven. An empty packing box is first halted by a stop in between rollers on the packing box conveyor segment part of the rollers, after which fingers pushed upwards at the appropriate side of the packing box push against the packing box to move it sideways over and along its supporting rollers to an idle location of the packing box platform part of the rollers. At this location the packing box is halted by another stop between the rollers, which is retracted downward when the empty packing box is to be advanced to the filling position for filling the packing box with articles by the cassette, where it is halted by another stop. Subsequently, a next set of fingers pushed upward between rollers at the appropriate side of the filled packing box will move the filled packing box over its supporting rollers from the filling location of the packing box platform part of the rollers to the packing box conveyor segment part of the rollers, after which the filled packing box will be conveyed further along the packing box conveyor 110.

Figure 10B:
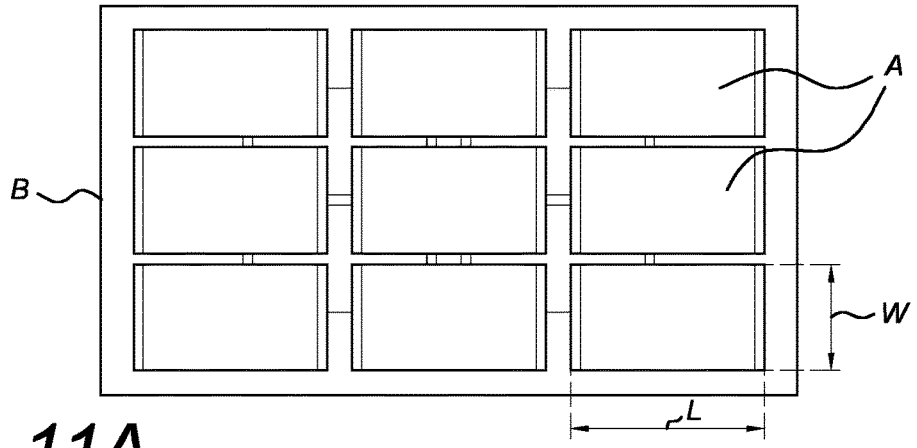

The packing machine 100 allows parallel and transverse packing of articles A, especially horizontal and vertical packing of articles, in packing boxes B. The articles A are supplied on a single article conveyor 120 and the packing boxes B are supplied on a single packing box conveyor 110. The packing box conveyor provides empty packing boxes to both the transverse packing arrangement 140 and the pick-and-place section with the pick-and-place robots 130, and discharges filled packing boxes from both the transverse packing arrangement and the pick-and-place section. Between the transverse packing arrangement and the pick-and-place section the packing box conveyor will convey both filled and empty packing boxes when both the transverse packing arrangement and the pick-and-place arrangement are employed for filling articles in transverse and parallel orientations, respectively, into the packing boxes. The packing machine is shown as having a linear configuration in which the packing box conveyor 110 is linearly arranged with the article conveyor 120 and the transverse packing arrangement 140 both in a linear configuration alongside. A linear configuration refers to the extension direction and the packing box and article conveying directions. FIGS. 10A and 10B show an example of articles that are packed in a parallel, especially horizontal, configuration in a packing box with a different filling of consecutive layers. FIGS. 11A and 11B show an example of articles that are packed in a transverse, especially vertical, configuration in a packing box with a different filling of consecutive rows. The packing machine allows for a very large variation of arrangements for packing article in packing boxes in both transverse and parallel orientations.

The invention claimed is:

1. A packing machine for packing articles into packing boxes having a bottom and an opposing top side, the packing machine comprising:

a packing box conveyor configured for conveying the packing boxes, wherein, in operation, the bottom of the packing boxes is supported on the packing box conveyor and the top side is directed upward;

an article conveyor configured for conveying articles in an article conveying direction over an article conveying surface, wherein the article conveyor is arranged adjacent and alongside the packing box conveyor, and each article has an associated article plane defined to be parallel to the article conveying surface when said article is on the article conveyor;

a pick-and-place arrangement configured and arranged, in operation, to pick articles, especially individual articles, from the article conveyor and place said articles directly in a parallel orientation into packing boxes on the bottoms of the respective packing boxes that are conveyed on the packing box conveyor with the top sides of the respective packing boxes in an open configuration, wherein the bottoms of the respective packing boxes provide a supporting surface for the articles placed in the packing boxes, and the parallel orientation of an article is an orientation of said article which has the respective article plane parallel to a respective supporting surface; and a transverse packing arrangement comprising a cassette that is movable between a collection position and a transfer position, wherein the transverse packing arrangement is configured, in operation, to present in the collection position an open side of the cassette sideward for collecting articles from the article conveyor into the cassette in a stacked relationship of the collected articles in the parallel orientation on a supporting cassette side as the supporting surface, and to subsequently in the transfer position, in which the cassette is rotated with respect to the collection position, provide the collected articles from the cassette in a transverse orientation into a packing box having the top side in an open configuration directed upward, wherein the bottom of the respective packing box provides a supporting surface for the articles provided in the packing box from the cassette, and the transverse orientation of an article is an orientation of said article which has the respective article plane transverse to a respective supporting surface, wherein the packing box conveyor is arranged, in operation, to convey packing boxes to and from the transverse packing arrangement for packing articles by the transverse packing arrangement in the transverse orientation into packing boxes conveyed on the packing box conveyor.

2. The packing machine according to claim 1, wherein the pick-and-place arrangement comprises at least one pick-and-place robot, optionally at least one pick-and-place delta robot.

3. The packing machine according to claim 1, wherein the packing box conveyor is arranged adjacent and alongside the transverse packing arrangement to convey packing boxes to and from the transverse packing arrangement.

4. The packing machine according to claim 1, wherein the transverse packing arrangement comprises a packing box platform configured to support at least one packing box for receiving articles from the cassette in the transfer position into said at least one packing box supported on the packing box platform, and the packing machine is configured to provide empty packing boxes from the packing box conveyor onto the packing box platform and to discharge packing boxes filled with articles from the cassette onto the packing box conveyor.

5. The packing machine according to claim 4, wherein the packing box platform provides for a filling location at which a packing box, in operation, is filled with articles by the transverse packing arrangement and for at least one idle location at which a packing box can be positioned while another packing box is positioned in the filling location, and the filling location and the at least one idle location are separated as seen along the packing box conveyor to allow discharging a filled packing box from the filling location and providing an empty packing box to the filling location along different respective paths.

6. The packing machine according to claim 5, wherein the packing machine is configured, in operation, to provide an empty packing box from the packing box conveyor to one of the at least one idle locations of the packing box platform, and subsequently from said one idle location to the filling location of the packing box platform.

7. The packing machine according to claim 1, wherein the transverse packing arrangement is provided in line in the article conveying direction with the article conveyor at a discharging end of the article conveyor.

8. The packing machine according to claim 1, wherein the transverse packing arrangement comprises a transfer conveyor for receiving articles from the article conveyor and to transfer articles from a discharging end of the transfer conveyor into the cassette arranged at the discharging end of the transfer conveyor, optionally wherein the transfer conveyor is arranged in line with the article conveyor at a discharging end of the article conveyor.

9. The packing machine according to claim 8, wherein the transfer conveyor is configured to transfer articles A from the transfer conveyor into the cassette by driving the transfer conveyor at a velocity providing sufficient speed to each article discharged from the transfer conveyor to bridge a gap between the transfer conveyor and the cassette.

10. The packing machine according to claim 8, wherein the pick-and-place arrangement is configured and arranged to allow providing articles from the article conveyor onto the transfer conveyor.

11. The packing machine according to claim 8, wherein the packing machine is configured to initially pre-group articles into at least one set of pre-grouped articles on the transfer conveyor, and to subsequently transfer the pre-grouped articles from the transfer conveyor into the cassette.

12. The packing machine according to claim 11, wherein the packing machine is configured to pre-group articles in the set of pre-grouped articles having each subsequent article in the set partly overlapping a preceding article in the set, and a preceding article in the set is associated with the discharging end of the transfer conveyor.

13. The packing machine according to the claim 12, wherein the transfer conveyor is arranged in line with the article conveyor at a discharging end of the article conveyor to receive articles directly from the article conveyor on the transfer conveyor at a level lower than a level at which articles are conveyed on the article conveyor.

14. The packing machine according to claim 10, wherein the pick-and-place arrangement is configured to reposition articles on the article conveyor to allow providing the set of pre-grouped articles on the transfer conveyor.

15. The packing machine according to claim 11, wherein the pick-and-place arrangement is configured to reposition articles on the article conveyor to provide the set of pre-grouped articles on the transfer conveyor while receiving articles from the article conveyor onto the transfer conveyor.

16. The packing machine according to claim 11, wherein the transfer conveyor comprises a pre-grouping section for receiving articles from the article conveyor and pre-grouping said articles into a set of pre-grouped articles, and a transfer section in between the pre-grouping section and the cassette for receiving pre-grouped articles from the pre-grouping section and subsequently transferring said pre-grouped articles into the cassette.

17. The packing machine according to the claim 16, wherein the pre-grouping section comprises an endless conveyor belt, and the transfer section comprises an endless conveyor belt.

18. The packing machine according to the claim 16, wherein the transfer conveyor comprises at least two stretches of conveyor belt for driving along a common endless track, each stretch of conveyor belt is driven by a separate drive to allow driving the stretches of conveyer belt independent from one another, articles are initially pre-grouped on a stretch of conveyor belt in the pre-grouping section, and said stretch of conveyor belt is subsequently moved to the transfer section for subsequent transfer of articles into the cassette.

19. The packing machine according to claim 1, wherein the transverse packing arrangement is configured to move the cassette downward while collecting articles into the cassette, especially to move the cassette downward in a continuous non-stepped fashion while collecting articles into the cassette.

20. A packing method for packing articles into packing boxes (B) having a bottom and an opposing top side, the packing method comprising:

providing a packing box conveyor configured for conveying the packing boxes, wherein, in operation, the bottom of the packing boxes is supported on the packing box conveyor and the top side is directed upward;

providing an article conveyor configured for conveying articles in an article conveying direction over an article conveying surface, and arrange the article conveyor adjacent and alongside the packing box conveyor, and each article has an associated article plane defined to be parallel to the article conveying surface when said article is on the article conveyor;

providing a pick-and-place arrangement to pick articles, especially individual articles, from the article conveyor and to place said articles directly in a parallel orientation into packing boxes on the bottoms of the respective packing boxes that are conveyed on the packing box conveyor with the top sides of the respective packing boxes in an open configuration, wherein the bottoms of the respective packing boxes provide a supporting surface for the articles placed in the packing boxes, and the parallel orientation of an article is an orientation of said article which has the respective article plane parallel to a respective supporting surface;

providing a transverse packing arrangement comprising a cassette that is movable between a collection position and a transfer position, wherein the transverse packing arrangement is configured to present in the collection position an open side of the cassette sideward for collecting articles from the article conveyor into the cassette in a stacked relationship of the collected articles in the parallel orientation on a supporting cassette side as the supporting surface, and to subsequently in the transfer position, in which the cassette is rotated with respect to the collection position, provide the collected articles from the cassette in a transverse orientation into a packing box having the top side in an open configuration directed upward, wherein the bottom of the respective packing box provides a supporting surface for the articles provided in the packing box from the cassette, and the transverse orientation of an article is an orientation of said article which has the respective article plane transverse to a respective supporting surface, wherein the packing box conveyor is arranged to convey packing boxes to and from the transverse packing arrangement to allow packing articles by the transverse packing arrangement in the transverse orientation into packing boxes conveyed on the packing box conveyor;

conveying packing boxes on the packing box conveyor, wherein the bottom of the packing boxes is supported on the packing box conveyor and the top side in an open configuration is directed upward;

conveying articles on the article conveyor; and at least one of providing articles in parallel orientation into the packing boxes using the pick-and-place arrangement, and providing articles in transverse orientation into the packing boxes using the transverse packing arrangement.

* * * * *